US010413801B2

(12) United States Patent
Robinson

(10) Patent No.: US 10,413,801 B2
(45) Date of Patent: Sep. 17, 2019

(54) GOLF SCORING CARD AND SYSTEMS AND METHODS FOR USING THE SAME

(71) Applicant: Anthony David Grant Robinson, Empire Bay (AU)

(72) Inventor: Anthony David Grant Robinson, Empire Bay (AU)

( * ) Notice: Subject to any disclaimer, the term of this patent is extended or adjusted under 35 U.S.C. 154(b) by 0 days.

(21) Appl. No.: 15/547,473

(22) PCT Filed: Jan. 28, 2016

(86) PCT No.: PCT/AU2016/000016

§ 371 (c)(1),
(2) Date: Jul. 28, 2017

(87) PCT Pub. No.: WO2016/119009

PCT Pub. Date: Aug. 4, 2016

(65) Prior Publication Data

US 2018/0008880 A1 Jan. 11, 2018

(30) Foreign Application Priority Data

Jan. 29, 2015 (AU) ..... 2015900244
May 21, 2015 (AU) ..... 2015901856
Oct. 13, 2015 (AU) ..... 2015904161

(51) Int. Cl.

*A63F 3/06* (2006.01)
*A63B 71/06* (2006.01)
*G06Q 50/34* (2012.01)
*A63F 3/00* (2006.01)

(52) U.S. Cl.

CPC ..... *A63B 71/0616* (2013.01); *A63B 71/0669* (2013.01); *G06Q 50/34* (2013.01); *A63B 2225/15* (2013.01); *A63B 2225/20* (2013.01); *A63B 2225/50* (2013.01); *A63F 3/0005* (2013.01); *A63F 3/00082* (2013.01); *A63F 3/06* (2013.01); *A63F 3/0615* (2013.01); *A63F 3/0665* (2013.01)

(58) Field of Classification Search

CPC ..... A63F 3/0615; A63F 3/065; A63F 3/0665; A63F 3/0005; A63F 3/00082
USPC ..... 273/139, 245; 283/901, 903
See application file for complete search history.

(56) References Cited

U.S. PATENT DOCUMENTS 5,471,039 A * 11/1995 Irwin, Jr. ..... A63F 3/0665 235/375
6,296,250 B1 * 10/2001 Langan ..... A63F 3/00028 273/139
6,520,542 B2 * 2/2003 Thompson ..... B42D 15/045 229/70

OTHER PUBLICATIONS https://web.archive.org/web/20090102003934/http://www.thegolfballfactory.com/the-golf-bets-dots-or-junk.htm, "Golf Side Bets Dots or junk", Jan. 2, 2009.*

* cited by examiner

*Primary Examiner* — Benjamin Layno
(74) *Attorney, Agent, or Firm* — Seyfarth Shaw LLP

(57) ABSTRACT

A method for improving the experience of a participant of a sporting contest includes the steps of; offering to the participant a side bet in which there is a chance for the participant to receive a prize if the participant achieves or betters a target score In the sporting contest (Irrespective of the final Outcome—of the sporting contest), receiving acceptance of the offer by the participant who pays a wager for the side bet, assigning the participant a prize and a target score that needs to be achieved or bettered for the participant to be awarded the prize, and awarding the prize to the participant if the personal score Is equal to or better than the target score.

13 Claims, 4 Drawing Sheets

GOLF SCORING CARD AND SYSTEMS AND METHODS FOR USING THE SAME

FIELD OF THE INVENTION

The present invention relates to systems, methods and apparatus used for enabling a participant of a sporting contest to wager a side bet in which there is a chance that the participant will receive a prize if the participant achieves or betters a particular score in the sporting contest. Although the invention will be particularly described with reference to the game of golf, it is equally applicable to other sports, particularly those which rank participants by way of a handicap.

BACKGROUND TO THE INVENTION

A sport often has participants who engage in playing it for the excitement that the sport provides. For organised sports especially, there is a constant need to keep players interested and motivated in playing the sport, as often a player's interest wanes over time, leading to a decline in total player numbers of the sport. Many sports involve the provision of handicaps to some or all of the participants, as well as the ranking of possible final outcomes of a sporting contest. However, there may be other, as yet unrealised, ways of keeping players interested and motivated in playing a sport that have a more direct influence on the players.

SUMMARY OF THE INVENTION

It is an object of the present invention to improve the experience of a participant of a sporting contest by offering to the participant a side bet in which there is a chance to receive a prize if the participant achieves or betters a particular score in the sporting contest, irrespective of the final outcome of the sporting contest.

In a first aspect of the invention there is provided a method for improving the experience of a participant of a sporting contest, the method comprising the steps of:

(a) offering to the participant a side bet in which there is a chance for the participant to receive a prize if the participant achieves or betters a target score in the sporting contest, irrespective of the final outcome of the sporting contest;

(b) receiving an acceptance of the offer by the participant paying a wager for the side bet;

(c) assigning the participant a first prize and a target score that needs to be achieved or bettered for the participant to be awarded the prize;

(d) the participant engaging in the sporting contest and so recording a personal score, and (e) awarding the first prize to the participant if the personal score is equal to or better than the target score.

Preferably, the participant is also provided a chance to be awarded a second prize, irrespective of whether the participant achieved or bettered the target score to obtain the first prize.

In a second aspect of the invention there is provided a sticker, ticket or score card for use in the above described method and which is provided on a surface thereof with:

(i) revealable indicia that indicates the prize, and (ii) revealable indicia that indicates the target score, which if achieved or bettered, entitles the player to redeem the sticker, ticket or score card for the prize.

Preferably, the sticker, ticket or score card has a face value which represents the wager to be paid if the participant were to accept the offer of the side bet.

Preferably, the sticker, ticket or score card is further provided on a surface thereof with a visible first unique identifier.

Preferably, the at least one visible unique identifier comprises a barcode or other machine scannable indicia.

More preferably, the sticker, ticket or score card if further provided on a surface thereof with a revealable indicia which, when made visible, comprises a second unique identifier.

More preferably, the sticker, ticket or score card includes a hologram or other difficult to counterfeit indicia which is visible to the participant and which further establishes the authenticity of the sticker, ticket or score card.

In a more preferred form, the sticker, ticket or score card comprises a score card issued by an organiser of the sporting contest and which is provided on a surface thereof with content specific to a venue at which the score card is to be used.

Preferably, the content includes any rules specific to the venue that are relevant to the sporting contest.

Preferably, the sporting contest is the game of golf and the score card is a golf score card which has provision for recording one or more of the following:

the participant's name;

the participant's registration number;

the participant's club name;

the participant's golf handicap;

a marker's name;

a marker's golf handicap;

the participant's personal score for each hole of the game, and the participant's total personal score in the game.

In a third aspect of the invention there is provided a wagering system comprising a computer processor, data input means to the computer processor, data output means from the computer processor, data storage means, and communications means, wherein the wagering system is operated to generate a first prize and a target score that needs to be achieved or bettered by a participant of a sporting contest and who has paid a wager for a side bet that the participant will achieve or better the target score for the participant to be awarded the prize.

Preferably, the wagering system is operated to generate one or more first prizes and target scores such that an expected prize payout is less than the monetary amount of the wager or wagers paid.

Still more preferably, the wagering system is further operated to print or cause to be printed, one or more of the sticker, ticket or score card according to the second aspect of the invention.

Still more preferably, the wagering system further comprises an information terminal and a remote printing device located at a venue in which the sporting contest takes place, and communicating with the computer processor via the communication means, and wherein the remote printing device generates a sticker, ticket or score card on demand by the participant who has paid the wager for the side bet resulting in the issuing of a command to the information terminal and wherein the so generated sticker, ticket or score card is provided on a surface thereof with:

(i) indicia that indicates the prize;

(ii) indicia that Indicates the target score, which if achieved or bettered, entitles the player to redeem the sticker, ticket or score card for the prize.

Preferably, the data storage means maintains a record of the one or more of the sticker, ticket or score card printed or caused to be printed, and wherein the wagering system further comprises authentication means for authenticating a sticker, ticket or score card when the participant seeks to redeem the sticker, ticket or score card for the prize.

Preferably, the authentication means is operated by entering at least one unique identifier of the sticker, ticket or score card into the information terminal which then communicates electronically with the authentication means to obtain verification that the sticker, ticket or score card is authentic and unredeemed, and to confirm the prize and the target score that is recorded in the data storage means of the wagering system and that is associated with the at least one unique identifier.

More preferably, the wagering system is configured to communicate with an Information terminal located at a venue in which the sporting contest takes place, and wherein at least one unique identifier of the sticker, ticket or score card is entered into the information terminal along with Information to identify and record the participant for whom the sticker, ticket or score card was issued.

Preferably, the wagering system is further configured to receive from the information terminal Information comprising the at least one unique identifier to confirm that it has been provided to the participant, the participant's identification Information, and the venue at which the information terminal is located.

Preferably, the information terminal includes a scanner of barcode or other machine readable information which serves as the at least one unique identifier, the scanner communicating with the computer processor via the communication means during a purchase and/or a redemption of the sticker, ticket or score card by or on behalf of the participant.

In a further embodiment of the third aspect of the invention, the communication means of the wagering system communicates with a mobile communications device of a participant of a sporting contest, wherein the wagering system is configured to:

(a) receive an input from the mobile communications device that indicates that the participant is to wager a side bet that the participant will achieve or better a target score in the sporting contest for the participant to be awarded a prize;

(b) provide to the participant through the mobile communications device a virtual sticker, ticket or score card in which the participant is informed of the prize and the target score that needs to be achieved or bettered by the participant in the sporting contest;

(c) receive from an authorised third party the results of the sporting contest, including a personal score of the participant;

(d) award the prize to the participant if the personal score is equal to or better than the target score.

In a still further embodiment of the third aspect of the invention the wagering system is operated to generate a prize and a target score based on historical records of redemptions for a particular sporting contest and/or for a particular venue for the sporting contest.

In a yet further embodiment of the third aspect of the invention the wagering system is operated to receive from the participant, via the communications means, an indication that the participant wishes to be provided a chance to be awarded a second prize, irrespective of whether the participant achieved or bettered the target score to obtain the first prize.

BRIEF DESCRIPTION OF THE DRAWINGS

Reference is now made to the following drawings of various embodiments of the invention.

DETAILED DESCRIPTION OF PREFERRED EMBODIMENTS

Figure 1:
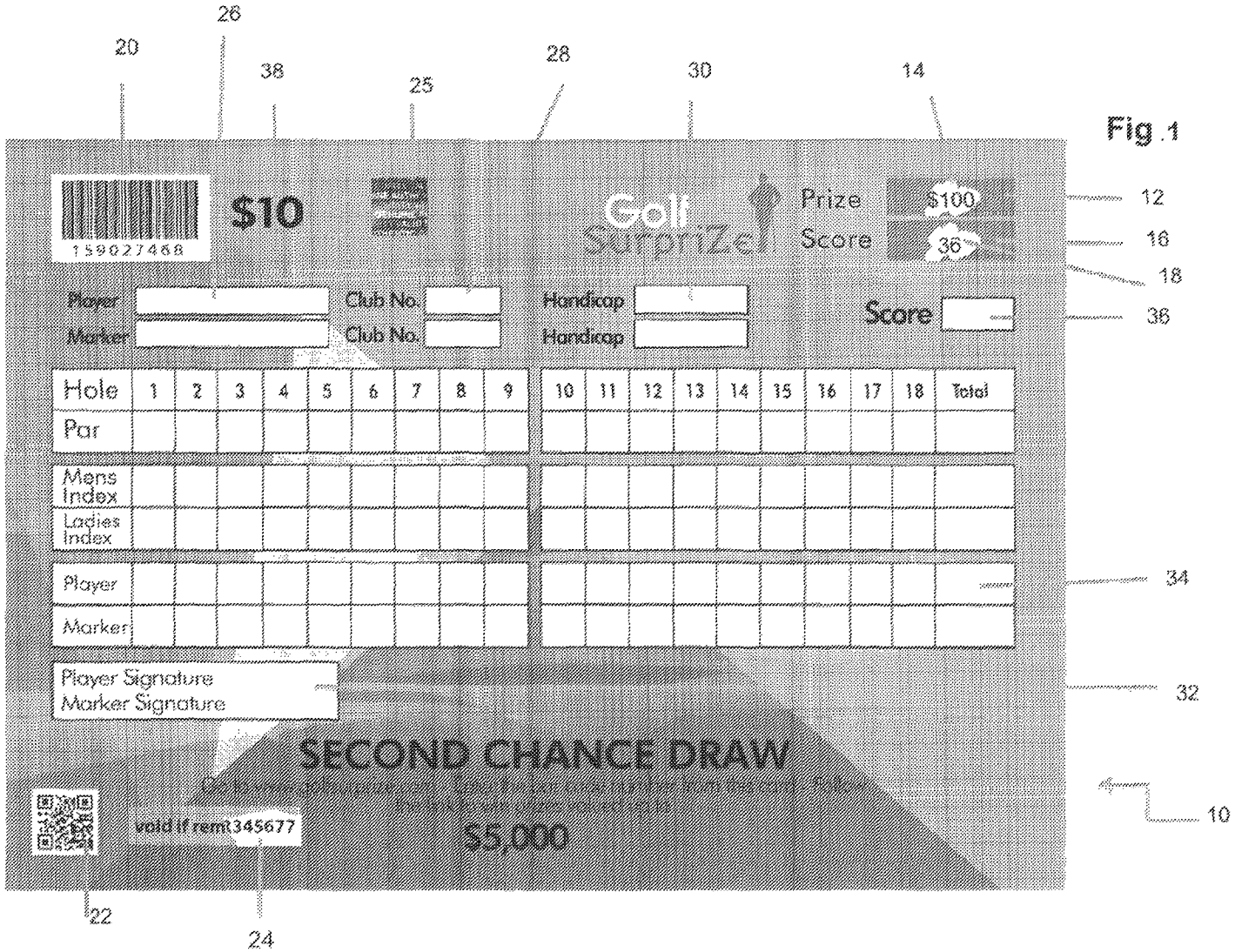
FIG. 1 illustrates a preferred embodiment of a score card according to the second aspect of the invention.

Referring to the Figures generally, there is disclosed herein a system for performing a wagering method that utilises a modified golfing score card. The method provides a participant with an exciting side bet on his or her own performance in a sporting contest. The nature of the invention lends itself to being implemented in sporting contests in which there are handicap systems and detailed and diligent record keeping. The game of golf is an example of such a sport. Golf tournaments are held at golf clubs all around the world regularly. The game of golf is highly regulated in many countries with national bodies overseeing the contests that take place in their jurisdictions. In Australia, all amateur and professional golfers are registered with a unique GolfLink number and have a handicap assigned to them so that players can compete against participants with varying degrees of skill. Note that in this complete specification, a golfer may also be referred to as a player or participant.

Golf is scored in a number of ways which are largely interchangeable. The two main methods for scoring the outcome of a golfing contest are the Stableford method and the stroke play method. The stroke play method simply counts the number of strokes taken to complete the course. The lower the number, the better the outcome. The Stableford method, on the other hand, awards points based on comparison of the number of strokes taken to a fixed score, usually par. This fixed score is then adjusted in relation to the player's handicap. The player's daily handicap for any given course is determined by multiplying a player's handicap with the slope rating and dividing by 113. Once a player has taken two strokes more than the adjusted fixed score, they may pick up their ball and resume play on the next hole. By utillsing daily handicaps, two golfers of differing skills can compete on a levelled playing field and, in the present invention, the use of daily handicaps means that players can place wagers on themselves to play to the best of their abilities.

The present invention is directed principally to a method of administering a side wager in which the outcome of the golfing contest has no bearing on the wager. In this way, a golfing participant may lose to competitor golfers but, nevertheless, win the side bet which is wagered against his or her own performance.

The use of modified golf score cards or stickers or separate tickets which are associated with the scoring of the golfing contest is central to the method, as is the use of a wagering system for generating, selling and redeeming the score cards, stickers or tickets.

In a broad sense, the method entails providing the golfing participant with a score to be achieved or bettered (once adjusted for individual handicaps for the particular course that the contest is held on) and a prize which is redeemable from a provider if the score is achieved or bettered. In the present discussion, the reference to prize can be taken to be a reference to a cash prize comprising cash or credit exchangeable for legal tender, or it may also refer to credit which is redeemable for goods and services (other than cash). Whether or not the prize is redeemable in cash will largely depend on the laws of the country in which the contest is played.

FIG. 1 depicts a score card 10 according to the second aspect of the invention. On the front face of the score card 10 there is shown a prize panel 12 that, when scratched, reveals the prize 14. Score panel 16 is also provided on score card 10 and when it is scratched, it reveals the Stableford method score 18 that a golfer must achieve or better in order to win the prize 14. There is also provided a barcode 20 which is used to uniquely identify the score card 10 (either by scanning the code or by entering the numbers identified in the barcode). The barcode 20 is unique amongst a plurality of score cards 10 and is used to identify the score card and records maintained in respect of it in the wagering system that administers the wager. Other identifiers could be employed, such as QR codes 22 or similar scannable indicia, instead of barcode 20. Optionally, a hidden unique identifier 24 may be used for verification purposes at the time of redemption, that is, if it remains unscratched it signifies that the score card 10 is unlikely to be a copy when it is eventually scratched and confirmed to be authentic. In an alternate embodiment, a QR code 22 can be scanned by mobile communications devices, such as iPhone's and iPads, and upon such scanning the golfer will be taken to a website where he or she can register for a second chance draw by entering identification information as well as one or more of the unique identifiers. FIG. 1 also depicts an optional hologram 25 or other similarly difficult to counterfeit element or indicia which is used to reassure the participant and the provider at redemption that the score card 10 is authentic.

Score card 10 also provides an identification panel 26 that is used to record a player's name, a club number panel 28 for recording a player's unique identifier, a handicap panel 30 for recording a player's handicap, and a signature panel 32 for recording a player's signature.

The score card 10 also has traditional elements of a score card including a score panel 34 for recording the score or scores achieved during the playing of the game and the ultimate score 36 that is adjusted to account for the participant's daily handicap. The score card 10 may also be tailored to the venue it is intended to be used in. In particular, the score card 10 may feature a rule panel (not shown) for showing rules particular to the venue where the game is played and may also feature advertising panels which could be used by the venue to generate funds to purchase the score cards 10 from a score card manufacturer. Alternatively, score card 10 may feature pictures of the venue or any other information that the venue operator wishes to include. Score card 10 may be sold by reference to face value indicia 38 which, in FIG. 1, is depicted as $10. This is in essence the amount wagered by the participant to participate in the side bet.

Figure 3:
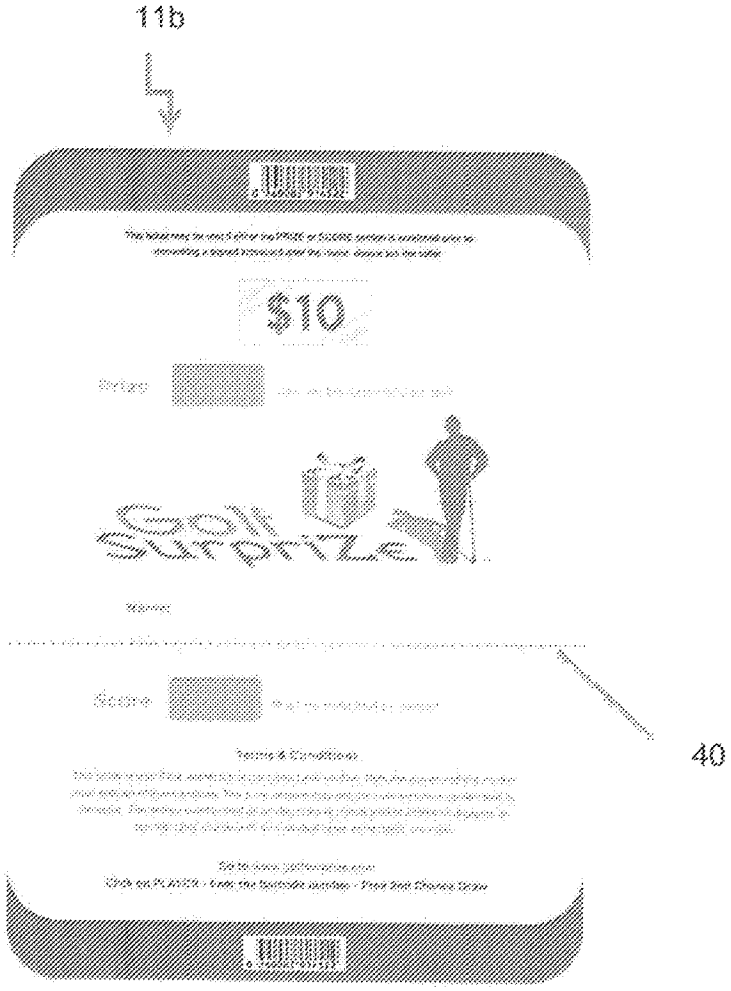
FIG. 3 illustrates a further preferred embodiment of a sticker according to the second aspect of the invention.
Figure 2:
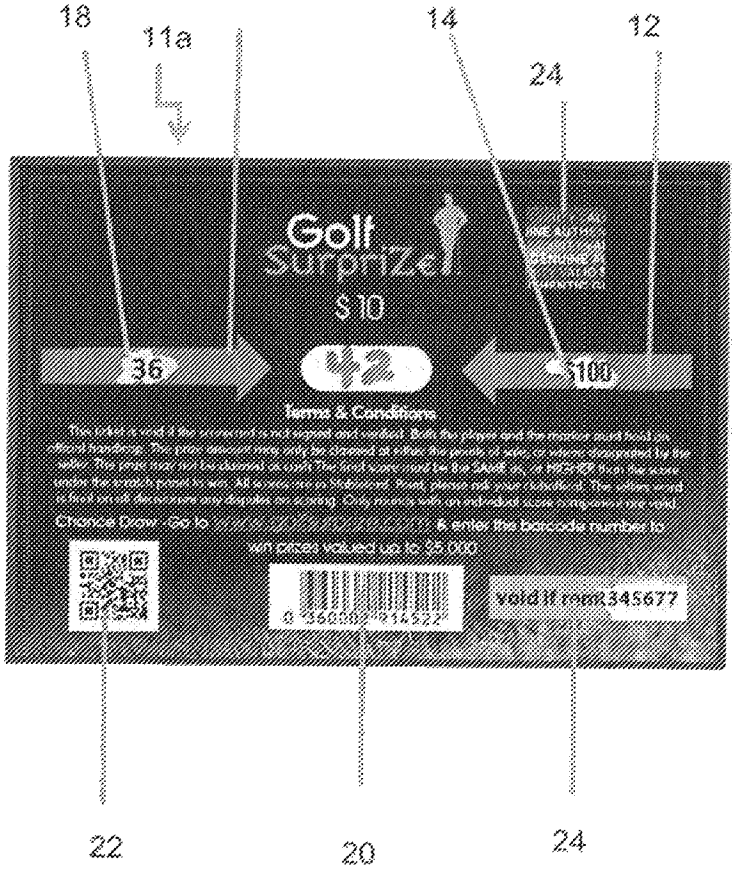
FIG. 2 illustrates a preferred embodiment of a sticker according to the second aspect of the Invention.

FIGS. 2 and 3 depict second and third embodiments respectively of a sticker according to the second aspect of the invention. These stickers 11*a*, 11*b* are affixed to traditional, preprinted score cards to produce a score card of the present invention.

The sticker 11*a* of FIG. 2 features a prize panel 12 and a score panel 16, each of which is scratchable to reveal the prize 14 and the score 18, respectively. The sticker 11*a* also features a unique identifier comprising barcode 20. The sticker 11*a* has an additional hidden unique identifier 24, as well as a QR code 22. The score cards to which the sticker 11*a* (and the sticker 11*b*) are applied have the remaining features that were described above with reference to the score card 10.

The sticker 11*b* of FIG. 3 differs from the sticker 11*a* of FIG. 2 in the sense that sticker 11*b* is adapted to be tom in two pieces along line 40 by the party issuing the sticker. In this embodiment, either the prize 14 or the score 18 can be left in the issuer's possession and not provided to the participant until after the golfing contest has concluded, thereby making it necessary for the participant to again visit the issuer such as at a shop or other commercial establishment of the issuer, and creating enhanced anticipation for the participant.

Figure 4:
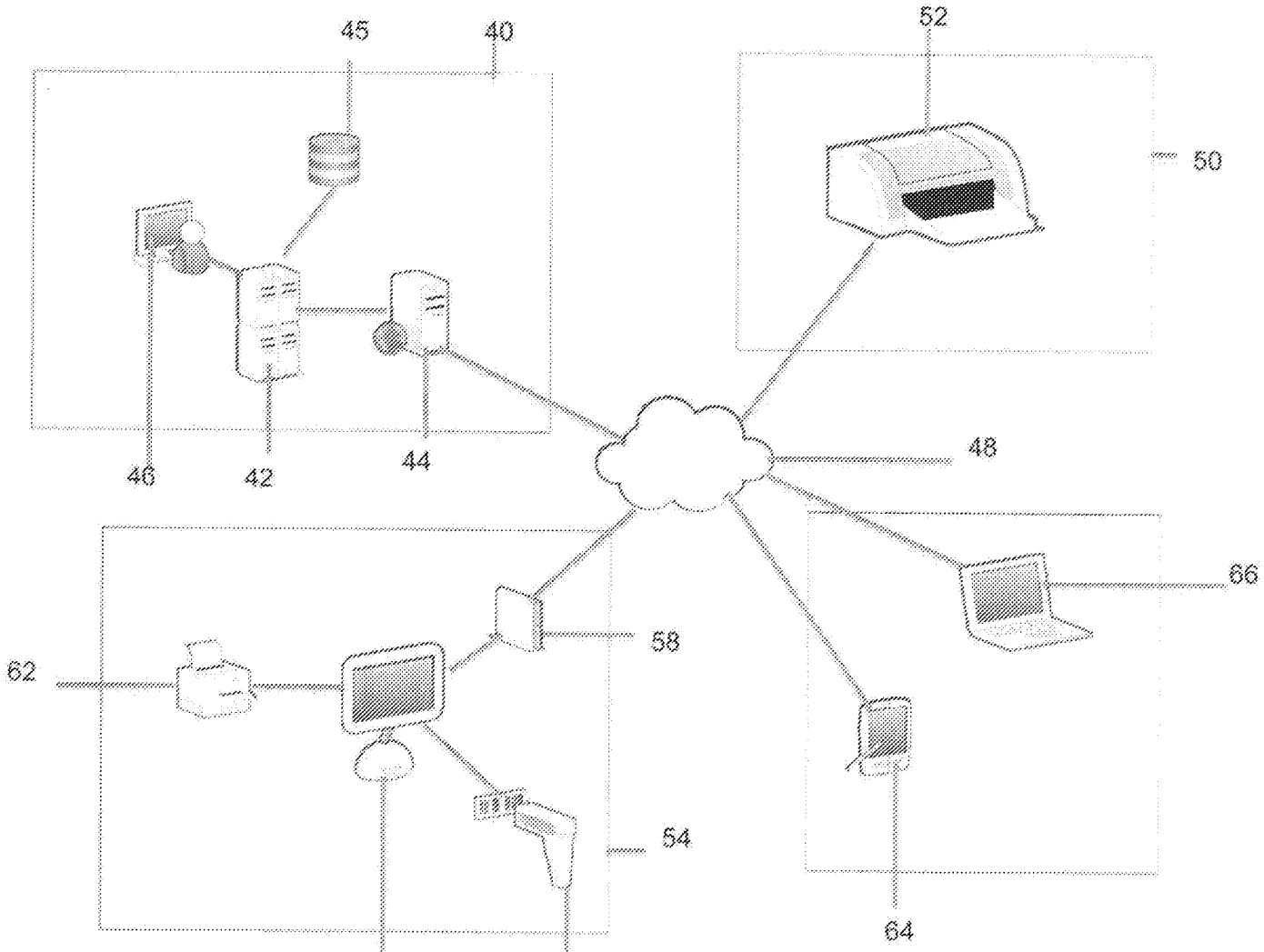
FIG. 4 is a schematic representation of a preferred wagering system of the third aspect of the invention.

Turning to the third aspect of the invention exemplified in FIG. 4, there is illustrated therein a wagering system 40 which comprises various components that may be physically separate (as shown) or may be integrated within one device. The components include an application server 42 which communicates with other components of the system via internet server 44 and internet 48. The application server 42 is administered via a user interface terminal 46 which may be connected locally (as shown) or via the internet 48 (not shown).

Score cards, stickers or tickets incorporating a prize 14 and a score 18 are generated by the wagering system 40 via a connected print house 50 containing a printer 52. Printer 52 may be connected to the other components locally (not shown) or via the internet 48 (as shown). The printer 52 may comprise a conventional offset printer or may comprise a digital printer capable of printing the stickers, tickets or scorecards with revealable indicia (e.g. scratch panels).

The application server 42, which includes the main microprocessor for the system, also communicates with an Information terminal 54 at a venue. The information terminal 54 comprises a point of sale (POS) computer 58 connected to both a communications device, such as a modem 58 and also scanner 60 for scanning score cards 10. Optionally, a ticket or label printer 62 is provided to print tickets or stickers or score cards on demand if preprinted stickers or tickets or score cards are not utilised.

The application server 42 is also connected to a smartphone 64 of the participant. Smartphone 64 contains a camera which is adapted to scan one or more of the Indicia provided on score card 10 so that the player may have access, via the QR code 22, to a website controlled by an administrator of the wagering system 40. In alternate embodiments, the wagering system 40 provides to the smartphone 64 a virtual score card in response to a request from a participant who pays a wager to obtain a score 18 and a prize 14. In this embodiment, the wagering system 40 communicates via the internet 48 with a third party repository of contest information to obtain independently verified golf contest results before paying any prizes to participants who have utilized such virtual score cards.

The application server 42 may also be accessed via the participant's laptop or personal computer 66 or smartphone 84 (via dedicated app or website) for the purpose of entering their identification details in order to qualify for a second chance prize. The second chance prize can be arranged so as to randomly select a participant from a pool of participants playing for the second chance prize. Before entering the participant into the pool of participants, the application server 42 establishes the authenticity of the unique identifier entered via recourse to data storage module 45 which maintains a record of all score cards or tickets or stickers generated, sold and redeemed under the wagering system 40.

Information, including unique identifiers and other information about the users of the score card 10 (i.e. the participants) received from computer 56 or from a wireless handset (e.g. smartphone 64 or personal computer 66) connected via the internet 48, is stored in the data storage module 45 of the wagering system 40. The data storage module 45 may include temporary and/or permanent memory, and may comprise a database which is accessed by the application server 42 in performing a method associated with the wagering system 40, that method being explained in more detail below.

Figure 5:
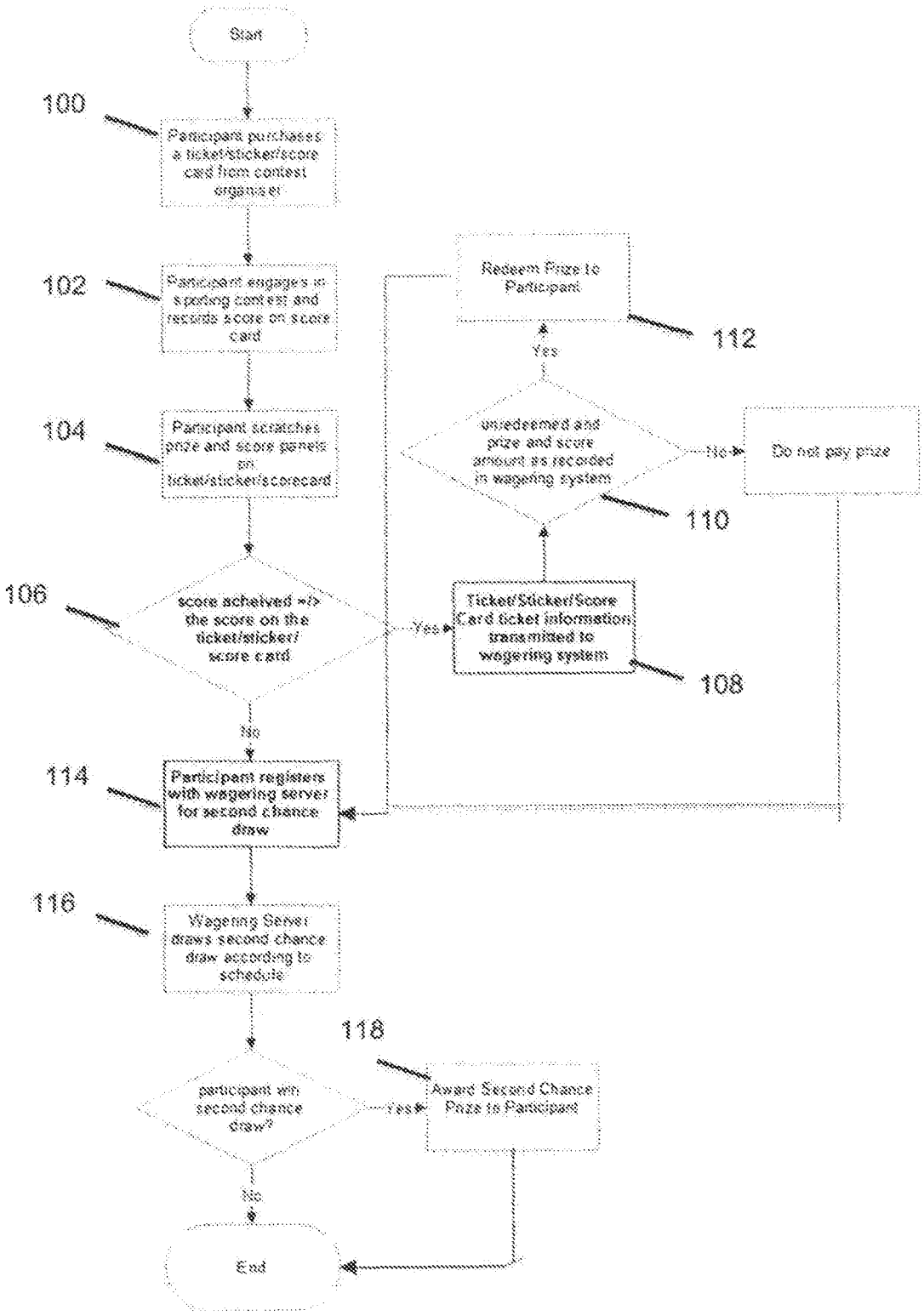
FIG. 5 is a flowchart of a preferred method of the first aspect of the invention.

By way of example, the method according to the first aspect of the invention is described with reference to FIG. 5 which is a flowchart of a method which utilizes the components of the wagering system 40 described with reference to FIG. 4. Furthermore, any reference in the following description to score card 10 also includes a reference to a score card sticker 11*a* or 11*b* which has been affixed to a score card or to a ticket which has a prize panel 12, a score panel 16 and at least one unique identifier 20, 22, 24.

Step 100 comprises a participant purchasing a score card 10 for use in recording the scores achieved by the participant of the sport or game. This will ordinarily be conducted at the golf course when the player pays for their round of golf. Before providing the score card 10, the vendor scans the visible barcode 20 with scanner 60 attached to computer 56. In most embodiments this does not involve any communications with the provider's system 30. Alternatively, the venue operator can use its scanner 60 or a smartphone or internet enabled tablet that has been configured by way of software to scan the visible barcode 20. The venue, in doing so, records in wagering system 40, the unique identifier provided by the provider of the score card 10. Against this information, personal Identification information is recorded Into the phone 42 or computer 56 such as the participant's name and player's registration number. This information is passed back to the wagering system 40 through the telecommunications network 48 and communication module 44 where it is stored in a database of the data store 45. The information is parsed by the manufacturer's system 40 to firstly identify the individual score card records applicable to that particular score card 10. Included in these records are the score 16 and prize 14 information printed on the card. The personal information is then added to the record associated with that particular card. The information is stored so that during redemption, the wagering system 40 can verify to the venue operator, inter alia, the person to whom the score card was issued and the target score and prize associated with the score card 10. In some alternate embodiments the player's identification is not captured and/or sent to the wagering system. In this embodiment the wagering system 40 is only told which score cards 10 have been sold and when.

In either embodiment, the player or participant then participates in the sporting contest in step 102 and uses the score card 10 to record their own performance during the round of golf on the scoring panel 36.

Upon completion of the game of golf, the player returns to the venue operator that provided them the score card 10 with his or her score on the score panel 36. In a preferred embodiment of the second aspect of the invention, the scratch panels 12 and 16 are not revealed until back at the venue, and in front of the venue operator, and more preferably, by the venue operator in step 104. In alternate embodiments, the prize and/or score can be disclosed to the participant prior to engaging in the sporting contest.

In step 106 if the score 36 is equal to or betters the score 18 hidden under the scratch panel 16, the player becomes entitled to the prize 14.

In a preferred embodiment, the venue operator provides the prize after having purchased the score cards 10 off the wagering system operator and resold them to players or participants for their face value 38. In this embodiment, the method of redeeming the score cards 10 for the stipulated prizes, is as follows. Firstly, the barcode 20 number is entered into a website or into a dedicated application connected to, or website served up by the wagering system. This may be simplified by using a scanner 60 or similar device such as a suitably adapted smartphone. The winner's name and player registration number is then entered and transmitted with the barcode data and venue identification to the wagering system 40 in step 108.

The information is received by the wagering system 40 which then queries its data store 45 to obtain, at least, the prize and score information associated with the score card 10. In embodiments where the player information is uploaded to the provider's system 54 at the point of sale, the player's information that has become associated with the score card 10 is also obtained. The wagering system 40 then compares the transmitted information with the stored Information and if the information matches, confirms that the score card is authentic and not previously redeemed and further provides instructions for redeeming the prize 14 in step 110 and 112 respectively.

Potential for fraud can be reduced by having a hidden unique identifier 17 that can optionally be checked upon the return of the score card 10 to the provider, or by scratching/revealing it during the redemption process so that it can be provided to the wagering system 40 and compared to the stored information which includes this identifying information which could not be known to the participant who returns with this panel unscratched.

In either the event that the prize has been redeemed or where the participant has failed to achieve score 18, the participant has a second chance at winning a second chance prize by registering with the wagering system 40 in step 114. The wagering system is configured to regularly and randomly draw one or more of such registered participants in step 116. If the participant is one of the ones drawn in step 116 the prize is awarded to them in step 118.

Scores and Prizes

In a preferred embodiment the operator of the wagering system sells batches of score cards 10 (or stickers/tickets) and profit share with the venue operator. For instance 500 score cards with a face value of $10 each would net gross income of $5,000. Out of this income the venue operator would need to pay out prizes.

The manufacturer or provider of the cards can however offer a deck of cards with a much higher aggregate prize 14 value in excess of $5,000 as it is statistically very unlikely that all persons who get a score card 10 will achieve the score required to be paid the prize. In this way excitement can be increased by offering high prizes whilst at the same time keeping the aggregate expected payout to be less than the amount collected.

In the following examples disclosure is provided as to how to generate decks of (n) cards 10 with scores and prizes that would be expected to return a given amount.

In preparing the forgoing examples it is important to consider the percentage chance of a golf player with a given daily handicap shooting their handicap, one better than their handicap, two better than their handicap etc. up to four better than their handicap is set out in the following table where i is the number of shots better than their handicap that is shot by the player:

TABLE 1

| percentage chance of a golfer shooting their daily handicap of better | |
|---|---|
| i = (the number of shots better than handicap) | % chance of scoring ($p^i$) |
| 0 | 0.198 |
| 1 | 0.144 |
| 2 | 0.098 |
| 3 | 0.063 |
| 4 | 0.039 |

By using this information the reader will appreciate that it will be possible to determine the chance of a golfer achieving a particular Stableford score (in which a person who shoots their handicap is awarded 36 points). By multiplying this probability with the score an expected payout can be calculated for each card. These can be summed over n different cards to determine the average expected payout for the deck of n cards.

A purely "fair" game would provide no profit or benefit for either the provider of the cards/club or the player. In order to generate profit, the provider of the cards adjusts the prize to become a positive expectation for the provider. For example, the average golfer will shoot or beat his handicap 19.8% of the time. A "fair" prize for a $10 entry would be approximately $40. This can be represented by the formula $$d = \frac{1}{p^i}$$

Where d represents the fair prize on a $1 entry fee and p represents the probability of beating the handicap by i or more shots. By offering a game paying less than d dollars for each dollar spent, the provider is ensured profit over the long term.

However just because a deck of n cards is profitable does not mean that it is engaging for players to play. In order for players to be or stay engaged they must be excited. There are two ways to achieve this:

i. Adjust number of cards for each i (where i is the number of shots or better they need to shoot to qualify for the prize)

ii. The payouts for each card within each group of i's; some more than fair some less than fair.

For example:

i. Eg. Allocate 40% of the cards to the easiest goal where i=0, and 24% of the set to the second easiest goal where i=1.

ii. Eg. Provide a variety of payouts for the goals where i=0 and 1 iii. Eg. Set some of the payouts for the goal where i=0 to average higher than the expected probability. (In other words, frequent small winners)

iv. Eg. Set some of the payouts for goals where i=1, 2, 3, and 4 to be lower than the fair amount Provided in Table 2 below is an example deck of 500 cards along with their face value if all of the prizes were won.

TABLE 2

| Example 500 card pack constituent | | | |
|---|---|---|---|
| Number | Score | Prize | Face Value |
| 30 | 36 | $ 20.00 | $ 600.00 |
| 20 | 37 | $ 30.00 | $ 600.00 |
| 50 | 37 | $ 40.00 | $ 2,000.00 |
| 50 | 37 | $ 50.00 | $ 2,500.00 |
| 25 | 37 | $100.00 | $ 2,500.00 |
| 24 | 38 | $150.00 | $ 3,600.00 |
| 1 | 38 | $500.00 | $ 500.00 |
| 30 | 39 | $ 20.00 | $ 600.00 |
| 30 | 39 | $ 40.00 | $ 1,200.00 |
| 30 | 39 | $ 60.00 | $ 1,800.00 |
| 30 | 39 | $ 80.00 | $ 2,400.00 |
| 100 | 40 | $ 75.00 | $ 7,500.00 |
| 60 | 41 | $100.00 | $ 6,000.00 |
| 20 | 42 | $150.00 | $ 3,000.00 |
| 500 | | | $34,800.00 |

In the present example set out in Table 2 the example pack of 500 score cards 10 in the table above have prizes 14 with an aggregate face value of $34,800. To determine the average expected payout a Monte Carlo simulation of 100,000 rounds using the deck in Table 2 was performed. The simulation can be performed by using the data Table 1 and employing the following formula:

$$\text{Prize} = \sum_{j=1}^{N} p_j^b d_j^b$$

Where $p_j^b$ represents the probability of shooting what is on the card (the goal) derived from the data in table 1, and $d_j^b$ represents the amount paid to the player if the card is won from Table 2.

Effectiveness, and profit consistency was tested by repeated Monte Carlo simulations of golfer rounds, using random draws without replacement and where the player was required to better the score or goal. A simulation of 100,000 sets of the 500 example cards from Table 2, sold for $10 per card, produced an average prize amount of $3,151 and a maximum prize amount of $5,400. Prizes over $5,000 occurred 31 times out of 100,000 times when the player is required to better the score or goal (that is not a match or better which is how the cards 10 have been described by way of example). The average prize over $5,000 was $5,155.48. Given the low likelihood of prizes in excess of $5,000, the vendor or manufacturer of the card 10 can guarantee participating clubs that any prizes exceeding revenue raised on a given pack of score cards 10 can be recovered from the vendor or manufacturer.

If the golfer has to match or better the goal instead of just beating it, there will be more winners and more prizes. A simulation of 100,000 rounds of golf of the 500 example cards of table 2 produced an average expected prize payout of $4,544 and a maximum prize amount of $7,355.

It follows that the provider can provide an exciting game for golfers, with frequent winners and significant prizes which are covered by the sale of the cards.

Delivering a Deck of n=1 Cards (Ie One at a Time)

In the embodiment where wagering system 40 is connected to a printer 62 located at the venue which is connected to the wagering system 40 over the internet 48 or via smartphone 64, score cards 10 are delivered one at a time at the sporting venue. In such an embodiment the score card 10 will be delivered (printed or virtually in the case of the smartphone) with all relevant information on the score card. The prize amount and goal will be immediately visible once the player pays for the ticket and it is printed or delivered in communication with the wagering system 40. In this embodiment where score cards 10 are printed or delivered on demand, the wagering system 40 can take into account the historical payout data associated with the particular venue and produce score cards 10 that meet the payout expectations of the participating sporting venue and the score card manufacturer. In the case of the delivery of prize and target score information electronically via a smartphone or other similar device in which the participant registers for access, the participants own history of performance and past redemptions can also be taken into account by the wagering system 40 during the allocation of prizes and target scores. These goals/target scores and payout figures can be adjusted on the fly. In alternate embodiment, the ticket or score card 10 might issue without a prize value. In this embodiment, the system, when presented with a winning players ticket (via redemption through a website or similar) calculates what prize to provide in a way that keep the average payout less than the face value of the cards sold previously.

Adjusting Deck Delivery

Whether decks of (n) cards 10 are being delivered in tranches or one card at a time, there may be a need to adjust the scores and prizes provided on the cards 10.

Notwithstanding that the probabilities set out in table 1 are adjusted to take into account the difficulty (measured by slope rating) of the course, by the formula: G.A. handicap× 121÷113=daily handicap, on a practical level the scores achieved may be lower than expected. Consequently the payouts will be lower than expected. In such cases the goals and prizes can be adjusted so that the average expected payout approaches the desired amount (whether it is below or greater than the amount received from selling the cards 10).

In one instance where decks of score cards 10 are printed via printer 52 and delivered physically to each golf club that purchases the score cards 10 the provider of score cards 10 will be informed as to the amount sold and amounts of prizes redeemed from the score cards 10 sold. This data, stored within the score card wagering system 40, can be interrogated by the software running on the application server 42 to identify anomalous payouts or payout levels generally. If it appears that players are winning too often at a particular course the wagering system 40 suggests and/or automatically adjust the scores 18 and prizes 14 so that the payouts conform to a payout level sought to be paid out by the manufacturer and participating golf course.

Handicapping

The aspect that makes the present invention unique is the fact that the player has a 'handicap' in the given sport. This means he is qualified to play the sport at a given level, is a member of a club and plays in competitions (not just socially). The purpose of a handicap has always been to enable two players of different skill levels to be able to compete against one another on equal terms. The cards of the present Invention are not produced in order for two players to compete against each other. The cards interact with the handicap in a different manner, as the cards generate scores that have a player on any given "handicap" needing to play at his peak in order to win the prize on the card. The handicap here Is being used to set a benchmark for which it has not been used before.

In other words score cards 10 will only produce winners when a player can equal or surpass his or her BEST efforts. Golf Club (X) might have players off handicaps of 3-24, while Golf Club (Y) might only have handicaps off 12-36. Tennis Club (A) might have players with handicaps of 2-5 while Tennis Club (B) might have players with handicaps of 6-10. Either way the score cards 10 of the present invention can reflect a players sport or club or handicap to reward the player for playing at their best or better.

The invention claimed is:

1. A method for improving an experience of a participant of a sporting contest, the method comprising:

generating, by a wagering system having a computer processor, a data input, a data output, a data storage, and a communication device, a target score and a first prize for a side bet in which there is a chance for the participant to receive the first prize if the participant physically participates in the sporting contest and achieves or betters the target score in the sporting contest, irrespective of a final outcome of the sporting contest;

receiving from the participant of the sporting contest a wager or fee in exchange for a promise to pay the first prize if the participant achieves or betters the target score;

physically participating in the sporting contest and building a personal score by the participant during the sporting contest;

calculating, by the wagering system, the personal score of the participant of the sporting contest, wherein the personal score is calculated by reference to participants' handicap; and awarding the first prize to the participant if the personal score is equal to or better than the target score.

2. The method of claim 1 wherein the participant is also provided a chance to be awarded a second prize, irrespective of whether the participant achieved or bettered the target score to obtain the first prize of the side bet.

3. The method of claim 1, further comprising printing a sticker, a ticket, or a score card provided with a unique identifier to identify the side bet.

4. The method of claim 3, in which the sticker, the ticket, or the score card further comprises:

revealable indicia that indicates the first prize; and revealable indicia that indicates the target score, which if achieved or bettered, entitles the participant to redeem the sticker, the ticket, or the score card for the first prize.

5. The method of claim 3, wherein the unique identifier comprises a barcode or other machine scannable indicia.

6. The method of claim 3, in which the sticker, the ticket, or the score card comprises a score card issued by an organizer of the sporting contest and which is provided on a surface thereof with content specific to a venue at which the score card is to be used.

7. The method of claim 3, in which the sticker, the ticket, or the score card comprises a sticker for applying to a golf score card.

8. The method of claim 1, wherein the sporting contest is a game of golf and the target score is a stabelford score in which the participants' handicap is used to generate a daily handicap used to calculate the participants' personal score for the sporting contest.

9. The method of claim 1, further comprising adjusting, by the wagering system, the target scores based on a course or venue of the sporting contest.

10. The method of claim 9, further comprising receiving, by the wagering system, personal scores of a plurality of participants and at least one of their corresponding unique identifiers and their corresponding handicaps.

11. The method of claim 10, wherein generating the target scores and prizes and receiving the personal scores of the plurality of participants is done on demand electronically as each participant seeks to purchase or redeem a side bet.

12. The method of claim 1 wherein the wager or fee comprises a specific price for each side bet and where the wagering system generates a plurality of target scores and prizes such that aggregate prices of the wagers paid by a plurality of participants is greater than expected payouts from the plurality of target scores and prizes associated with each participant and lower than an aggregate face value of the prizes.

13. The method of claim 1, further comprising generating, by the wagering system, a plurality of stickers, tickets, or score cards by reference to their expected value of payout.

* * * * *